US006693261B2

(12) United States Patent
Leutner

(10) Patent No.: US 6,693,261 B2
(45) Date of Patent: Feb. 17, 2004

(54) ELECTRIC STOVE TO COOK FOOD, AND THE LIKE

(75) Inventor: Kurt Leutner, Mainz (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 10/265,089

(22) Filed: Oct. 4, 2002

(65) Prior Publication Data

US 2003/0085217 A1 May 8, 2003

(30) Foreign Application Priority Data

Oct. 5, 2001 (DE) ..... 101 49 085

(51) Int. Cl.[7] ..... F27D 11/00

(52) U.S. Cl. ..... 219/393; 219/396; 219/522; 126/190; 126/200

(58) Field of Search ..... 219/393, 396, 219/391, 395, 397, 398, 411, 413, 522; 99/341; 126/190, 200

(56) References Cited

U.S. PATENT DOCUMENTS

| | | | | | |
|---|---|---|---|---|---|
| 3,612,825 | A | * | 10/1971 | Chase | 219/396 |
| 3,889,099 | A | * | 6/1975 | Nuss | 219/393 |
| 3,889,100 | A | * | 6/1975 | Dills | 219/393 |
| 3,892,224 | A | * | 7/1975 | McKelvey | 126/200 |
| 4,033,321 | A | * | 7/1977 | Krebs | 126/200 |
| 4,048,978 | A | * | 9/1977 | Plumat et al. | 126/200 |
| 5,588,421 | A | * | 12/1996 | Busch et al. | 126/200 |
| 5,732,614 | A | * | 3/1998 | Oslin | 99/341 |
| 5,881,710 | A | * | 3/1999 | Davis et al. | 126/200 |
| 6,570,135 | B2 | * | 5/2003 | Gros et al. | 219/396 |

FOREIGN PATENT DOCUMENTS

| | | |
|---|---|---|
| DE | 19849989 | 5/2000 |
| DE | 10050609 | 4/2002 |
| EP | 0490774 | 6/1992 |

* cited by examiner

*Primary Examiner*—Teresa Walberg
*Assistant Examiner*—Fadi H. Dahbour
(74) *Attorney, Agent, or Firm*—Nils H. Ljungman & Associates

(57) ABSTRACT

There is now provided an electric stove with an electric stove body having an exterior comprising side walls, a top, and a bottom spaced from said top. The top has a an exterior top surface on which are disposed a plurality of electric heating elements. The electric heating elements of the top surface are controllable by control apparatus to provide heat sufficient to cook food in cooking utensils, upon such cooking utensils being placed with their bottom on a corresponding electric heating element. The electric heating elements and their corresponding control apparatus are connected by electric circuitry such that the heat produced by the electric heating elements can be set at a desired temperature for cooking food. Electric heating arrangements are also found in the stove. These heating arrangements are connected by electric circuitry to control apparatus so as to permit selection of a cooking temperature in the electric stove. The electric stove also has a door with a viewing arrangement to permit viewing of the electric stove so as to ascertain the doneness of food being cooked in the stove. There is also provided a stove or the like, such as, a stove with an oven or an oven with a viewing area. This viewing area may distort a portion of the stove and allow heat to escape. This viewing area is designed to minimize distortion of this portion.

20 Claims, 9 Drawing Sheets

ELECTRIC STOVE TO COOK FOOD, AND THE LIKE

BACKGROUND OF THE INVENTION

1. Field of the Invention

This invention relates to an electric stove to cook food, and the like.

2. Background Information

In general terms, an electric stove can be used to cook food.

An electric stove typically comprises an electric stove body having an exterior comprising side walls, a top and a bottom spaced from said top. The top has a an exterior top surface on which typically are disposed a plurality of electric heating elements. The electric heating elements of the top surface can be controlled by control apparatus to provide heat sufficient to cook food in cooking utensils, such cooking utensils being placed with their bottom on a corresponding electric heating element. The electric heating elements and their corresponding control apparatus are connected by electric circuitry such that the heat produced by the electric heating elements can be set at a desired temperature for cooking food.

An electric stove also typically comprises electric heating arrangements in the stove. These electric heating arrangements are also connected by electric circuitry to control apparatus so as to permit selection of a cooking temperature in a stove.

Cooking utensils can typically be supported in an electric stove by way of an arrangement to support a cooking utensil in the electric stove.

Accordingly, an electric stove is an appliance that can be used to cook food at a desired temperature by heat such as heat generated by electrical energy transmitted from a source of electric energy to heating elements and the heat for cooking can be controlled by corresponding control apparatus.

Further, most stoves have a stove body having an exterior comprising side walls, a top and a bottom spaced from said top. The top has a an exterior top surface on which typically are disposed a plurality of heating elements. The heating elements of the top surface can be controlled by control apparatus to provide heat sufficient to cook food in cooking utensils, such cooking utensils being placed with their bottom on a corresponding heating element. The heating elements and their corresponding control apparatus are connected such that the heat produced by the heating elements can be set at a desired temperature for cooking food.

A stove also typically comprises heating arrangements in the stove. These heating arrangements are also connected to control apparatus so as to permit selection of a cooking temperature in a stove.

Cooking utensils can typically be supported in a stove by way of an arrangement to support a cooking utensil in the stove.

Thus, a stove is an appliance that can be used to cook food at a desired temperature by heat such as heat generated by energy transmitted from a source of energy to heating elements and the heat for cooking can be controlled by corresponding control apparatus.

It is also important for an electric stove to permit viewing of the food that is cooked with an electric stove in a manner that represents the true color of the food that is prepared with an electric stove.

Therefore, conventional stoves and ovens typically have a viewing arrangement that allows the user to see the food in the interior of the unit and to determine the degree of doneness of the food. A viewing arrangement typically has a multilayer glass module with an inside pane and a front pane, which module may distort and create situations where heat escapes from the appliance.

Typically very high temperatures occur within a baking oven muffle during operation thereof, particularly in the case of a baking oven with a pyrolytic or self-cleaning feature. The temperatures at the central region of the viewing arrangement are substantially greater than at the outer or peripheral region. There is accordingly created a large temperature gradient at the inner pane, from the central region to the peripheral region. This temperature gradient may cause a bulge-like deformation of the inner pane such that the inner pane, in the case of rotary doors, or swing doors or pivot doors, may be pressed away from the muffle or the associated muffle seal in the lower muffle region. This leads to a gap at the door through which heat can escape from the oven muffle.

Several design measures are known to deal with this problem.

German Patent Publication No. DE 198 49 989 A1 published on May 4, 2000, discloses a baking oven door in which the inner pane is shaped like a bowl. The distance of the pane away from the plane that is disposed or clamped at the flange of the muffle is greater in the central region than at the peripheral region of the plane. This yields a compensation of the operationally induced deformation. German Patent Publication No. DE 198 49 989 A1 published on May 4, 2000 and its corresponding European Patent Application No. EP 99 76 892, are hereby incorporated by reference as if set forth in their entirety herein.

Such a defined, bowl-shaped and bulged inner pane can only be manufactured with great effort, particularly since the bulge is in the range of millimeters (five to fifteen millimeters per ten millimeters).

OBJECTS OF THE INVENTION

It is one object of the present invention to provide an electric stove and components thereof.

It is also an object of the present invention to provide a stove with a window arrangement.

It is further an object of the present invention to provide an electric stove door window inner pane which can be formed with minimized effort for the baking oven door described in the foregoing which door is configured to close the feed opening of the oven muffle of a baking oven and which door comprises a door frame, which frame is configured to mount at least two glass and/or glass-ceramic panes, the panes being disposed in spaced-apart relationship along one another and the panes comprising an at least partially transparent front pane and a shaped inner pane which is positioned to face towards the feed opening.

It is also an object of the present invention to provide an oven with a window arrangement.

It is yet a further object of the present invention to provide a stove door window with a shaped inner window pane.

It is still further an object of the present invention to provide a stove door window inner pane which can be formed with minimized effort for the baking oven door described in the foregoing which door is configured to close the feed opening of the oven muffle of a baking oven and which door comprises a door frame, which frame is configured to mount at least two glass and/or glass-ceramic panes, the panes being disposed in spaced-apart relationship along one another and the panes comprising an at least partially transparent front pane and a shaped inner pane which is positioned to face towards the feed opening.

SUMMARY OF THE INVENTION

The invention teaches in one aspect an electric stove to cook food, said electric stove comprising: an electric stove body; said electric stove body being configured with an exterior comprising side walls, a top, and a bottom spaced from said top; said top comprising an exterior top surface; a plurality of electric heating elements disposed on said exterior top surface; said plurality of electric heating elements each being configured to receive the bottom of a cooking utensil to cook food on said electric stove; electric heating element control apparatus to control the operation of said electric heating elements to produce a temperature to cook food on said electric stove; electric circuitry configured to connect said heating element control apparatus and said plurality of electric heating elements to a source of electric power; a first electric heating arrangement disposed in said electric stove and being configured to heat said electric stove to a cooking temperature; a first electric heating arrangement control apparatus being configured to control the operation of said first electric heating arrangement to produce a cooking temperature to cook food in said electric stove; an arrangement to support a cooking utensil in said electric stove; a second electric heating arrangement disposed in said electric stove and being configured to heat said electric stove to a temperature greater than said cooking temperature; a second heating control apparatus being configured to control said second electric heating arrangement to produce a temperature sufficient to convert splatters and/or spills produced during cooking in said electric stove into a converted splatters and/or spills residue more easily removable from said electric stove than said splatters and/or spills produced during cooking in said electric stove; said electric stove being configured with an interior comprising an interior top surface, an interior bottom surface, interior side surfaces, and an interior rear surface; said interior top surface, said interior bottom surface and said interior side surfaces defining an inlet opening to introduce food to be cooked into said interior of said electric stove; said first electric heating arrangement being disposed in said interior of said electric stove and being configured to heat said interior of said electric stove to a cooking temperature; said first heating arrangement control apparatus being configured to control the operation of said first electric heating arrangement to produce a cooking temperature to cook food in said interior of said electric stove; said arrangement to support a cooking utensil being disposed in said interior of said electric stove; said second electric heating arrangement being disposed in said interior of said electric stove and being configured to heat said interior of said electric stove to a temperature greater than said cooking temperature; said second heating control apparatus being configured to control said second electric heating arrangement to produce a temperature sufficient to convert splatters and/or spills produced during cooking in said interior of said electric stove into a converted splatters and/or spills residue more easily removable from said interior of said electric stove than said splatters and/or spills produced during cooking in said interior of said electric stove; said electric stove comprising a stove door; said stove door and said electric stove comprising a hinge arrangement configured to permit said stove door to be positioned in a closed position, to close said inlet opening, and said hinge arrangement being configured to permit said stove door to be positioned in an open position, to open said inlet opening; said stove door comprising a window arrangement with a viewing area having a predetermined height and a predetermined width configured to view said interior of said electric stove; said stove door comprising a mounting arrangement configured to mount said window arrangement to said door; said window arrangement comprising: a first pane and a second pane; and a spacer arrangement being configured to maintain said first pane in an outer position with respect to said electric stove interior upon said stove door being in the closed position, and said spacer arrangement being configured to maintain said second pane in a position closer with respect to said electric stove interior than said first pane upon said stove door being in the closed position; said first pane comprising a substantially planar structure having a surface area substantially equal to said viewing area; said first pane comprising an at least partially transparent glass; said second pane comprising a first planar portion, a second, central, planar portion and a third planar portion; said second, central, planar portion comprising a central portion having a first surface disposed substantially parallel with respect to said first pane; said central portion being rectangular, having a first side and a second side opposite said first side and having a third side and a fourth side opposite said third side; said first planar portion and said third planar portion each having a thickness substantially equal to the thickness of said central planar portion; said central planar portion being bent at an intersection of said first side of said central planar portion with said first planar portion and said central planar portion being bent at an intersection of said second side of said central planar portion with said third planar portion; said first planar portion and said third planar portion each being disposed at a substantial obtuse angle transverse to said central planar portion; and said central planar portion being configured to expand in response to heat being produced by at least one of said first and second heating arrangements.

The invention also teaches a baking oven door that is configured to close the feed opening of the oven muffle of a baking oven. The door comprises a metallic door frame which is configured to secure at least two glass and/or glass-ceramic panes. These panes are disposed in spaced-apart relationship along one another and comprise an at least partially transparent front pane and a shaped inner pane which is positioned to face towards the feed opening.

The above-discussed embodiments of the present invention will be described further hereinbelow. When the word "invention" is used in this specification, the word "invention" includes "inventions", that is the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the embodiments which are illustrated in the accompanying drawings.

DESCRIPTION OF THE PREFERRED EMBODIMENT

Figure 1:
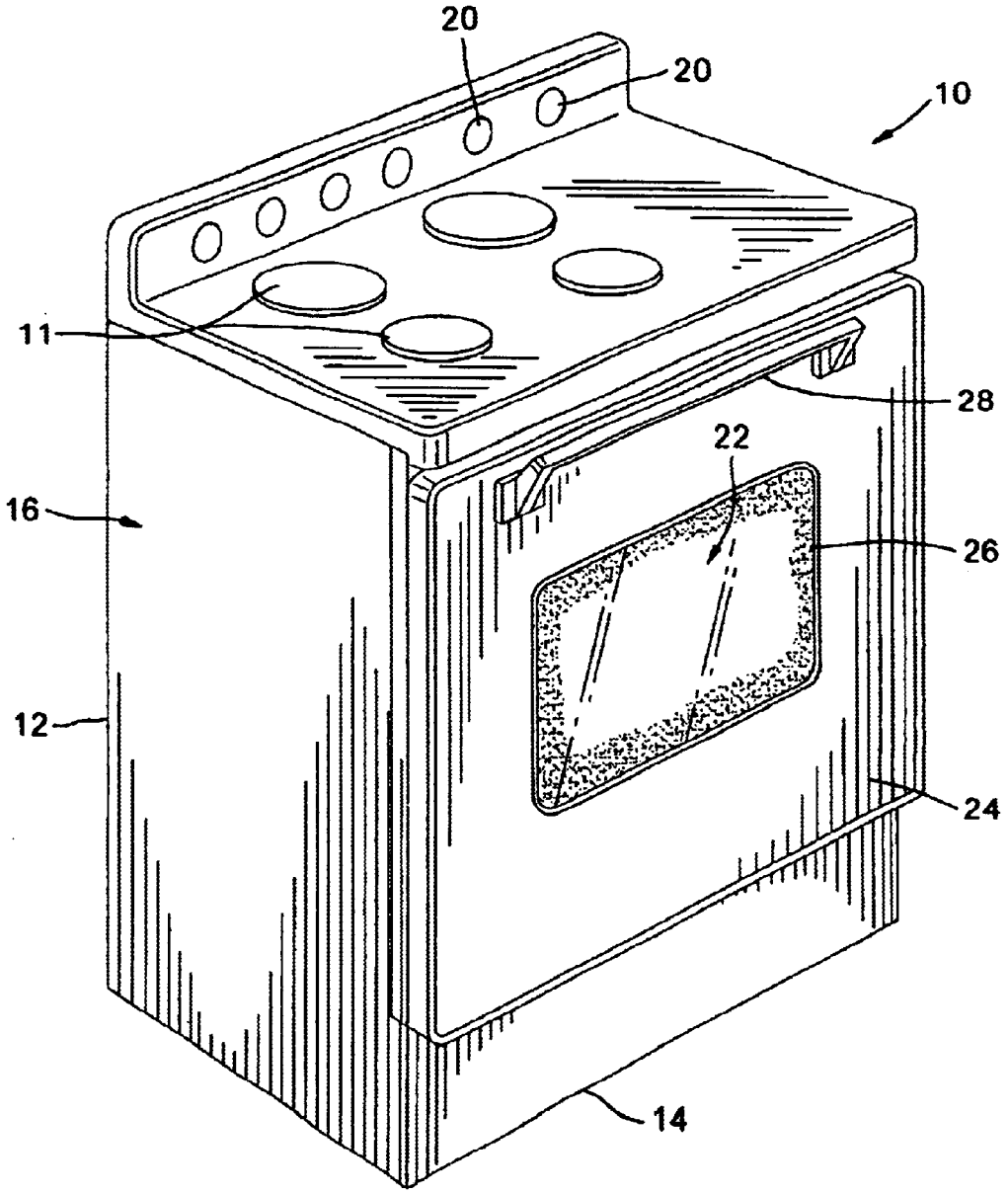
FIG. 1 is a perspective view of a stove in accordance with one embodiment of the present invention.

FIG. 1 illustrates an appliance, such as a stove 10, in accordance with one embodiment of the present invention. Stove 10 may possibly be an electric stove to cook food and a self-cleaning stove to cook food, the electric stove having a stove body 12 and being configured with exterior surfaces comprising a base 14, and walls generally identified by reference numeral 16, comprising side walls, a front wall, a top, a bottom, and a rear wall, with the exterior surfaces defining the interior 17 (FIG. 3) of the electric stove 10. The stove 10 has electric heaters 11 at the top and an electric heating arrangement 18 (FIG. 3), all configured and disposed to provide heat to cook food, and control apparatus 20 to control the electric heaters 11 and the heating arrangement 18. A planar glass structure or window arrangement 22 is disposed at the oven door 24 and mounted by an arrangement generally identified by reference numeral 26. The planar glass structure or window arrangement 22 is further described with reference to FIGS. 4 to 7, herein below. The oven door 24 has a handle 28 to open and close the oven door 24.

Figure 2:
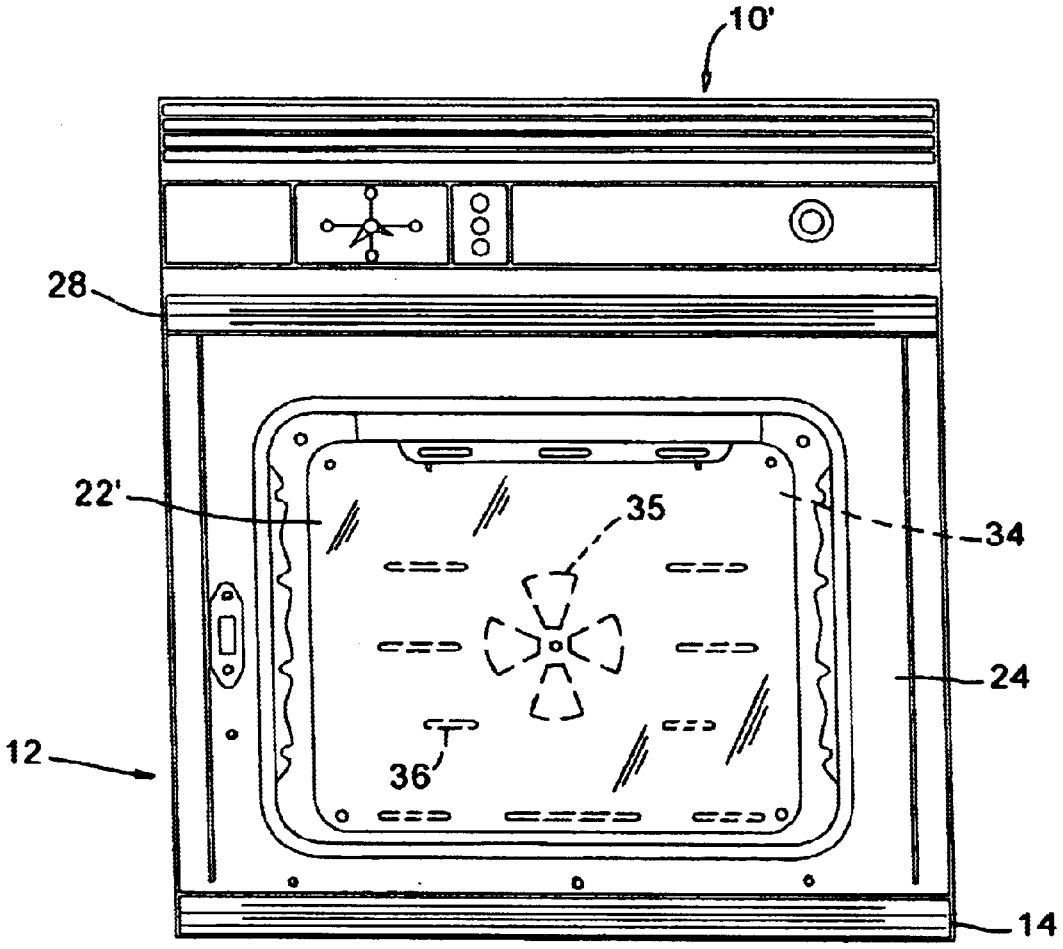
FIG. 2 is an elevational view of a stove in accordance with one embodiment of the present invention showing interior components.

FIG. 2 illustrates an embodiment of a stove 10' showing interior components, that is a back wall 34 with several apertures 35 in the form of circular sectors through which air can be sucked by a turbine (not illustrated). Other slit-like apertures 36 are formed in the surrounding portions of the back wall 34 to permit the passage of any air forced by the turbine into the oven enclosure. With this arrangement it is thus possible to produce a forced hot air convection within the interior 17. The stove 10' in accordance with FIG. 2 also has a glass structure or window arrangement 22' as will be described in greater detail below with reference to FIGS. 4 to 7.

Figure 3:
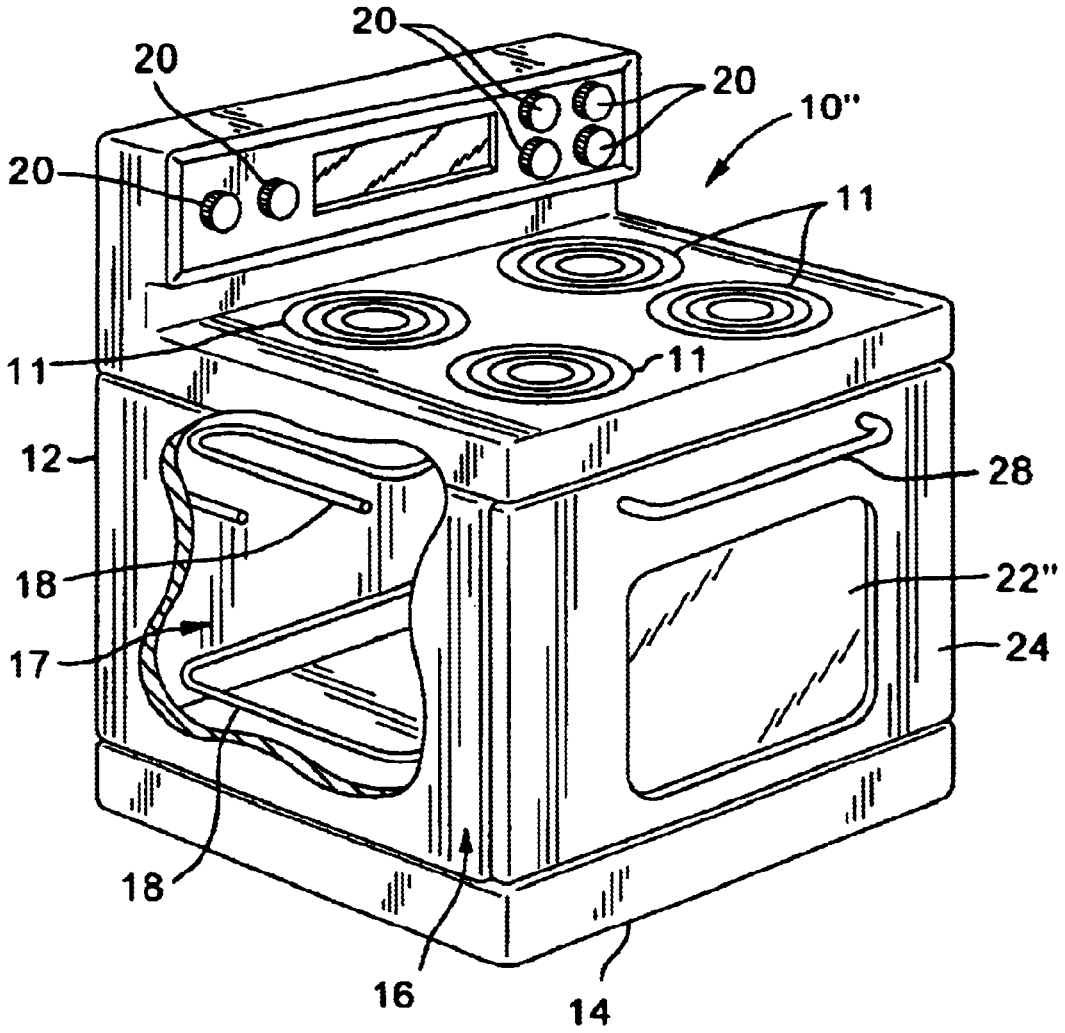
FIG. 3 is a perspective view of a stove in accordance with one embodiment of the invention showing further details of an oven.

FIG. 3 illustrates in greater detail the heating arrangement 18 for stove 10" in accordance with one embodiment of the present invention. The stove 10" in accordance with FIG. 3 also has a glass structure or window arrangement 22" as will be described in greater detail below with reference to FIGS. 4 to 7.

Figure 4A:
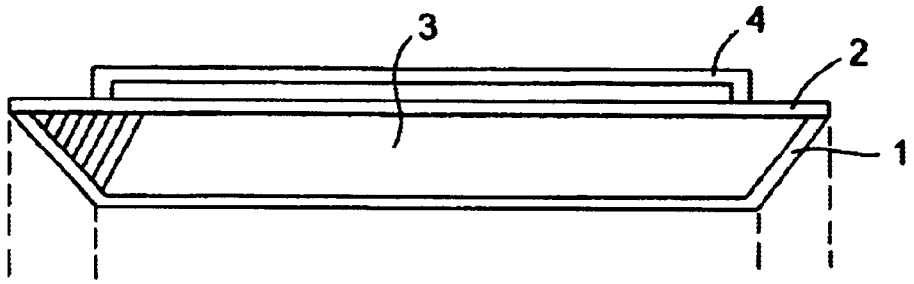
FIG. 4A is a diagrammatic top plan view of a frame and pane assembly for a baking oven window arrangement in accordance with one embodiment of the invention.
Figure 4B:
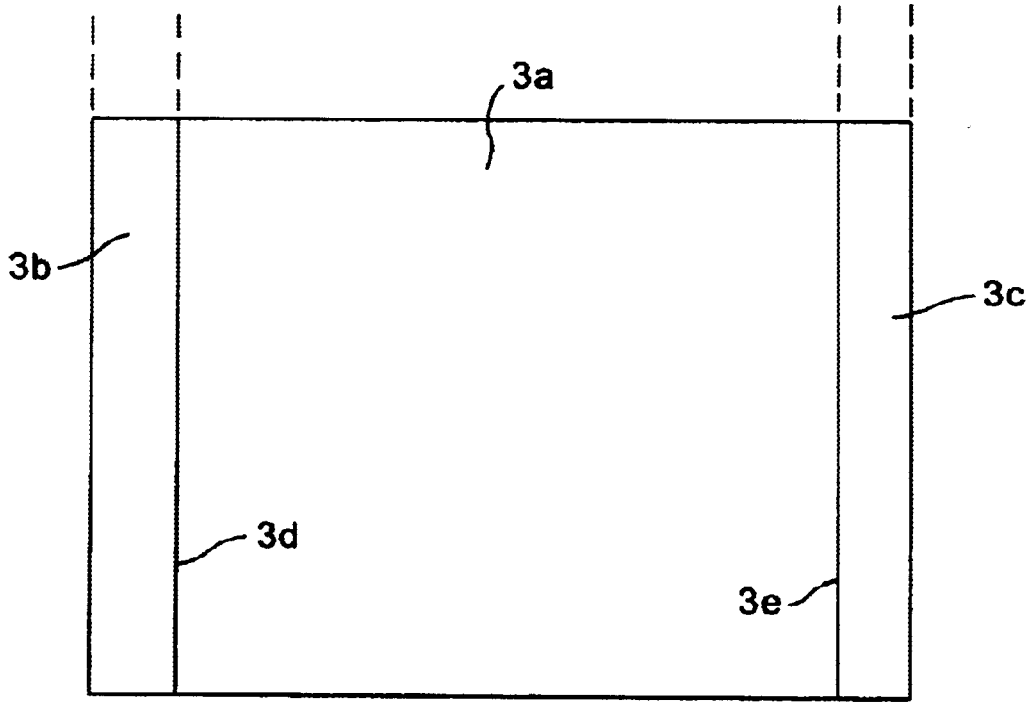
FIG. 4B is an elevation corresponding to FIG. 4A.

One embodiment of a window arrangement in accordance with the present invention is described in greater detail with reference to FIGS. 4A and 4B. These FIGS. 4A and 4B illustrate schematically the structure of an inner pane shaped in accordance with one feature of the present invention. FIG. 4A comprises a top plan view onto the upper side of the baking oven door, and FIG. 4B comprises a corresponding front view of the baking oven door.

The baking oven door has a mounting frame 1 comprised of a metal having a heat expansion coefficient that is minimized, in which frame are secured a front pane 2 and a shaped inner pane 3. The front pane is typically made of a glass that is thermally very stable, whereas the inner pane is preferably a glass-ceramic. Furthermore, a door grip 4 for opening and closing the baking oven door is illustrated in the top plan view.

The inner pane comprises a linear base member 3*a* that, in contrast to the state of the art, is not shaped like a bowl. The linear base member comprises at its two ends lateral members 3*b* and 3*c* which lateral members are inclined in the direction of the front pane 2. The angles of inclination or bending angles are preferably in the range of from 45 degrees to 60 degrees. The length of the lateral members is typically 30 to 40 millimeters.

It is preferred, as shown in FIG. 4B, that the inner pane 3 is mounted in such a way that the bending edges 3*d*, 3*e* extend vertically in the installed condition of the baking oven door. In such an arrangement there substantially do not exist problems with respect to space, so as to facilitate installation of door hinge hardware and the closing mechanism. The frame structure, moreover, is more simple.

It is within the scope of the invention that the inner pane is disposed in such a way that the bending edges extend horizontally in the installed condition of the baking oven door.

Figure 5:
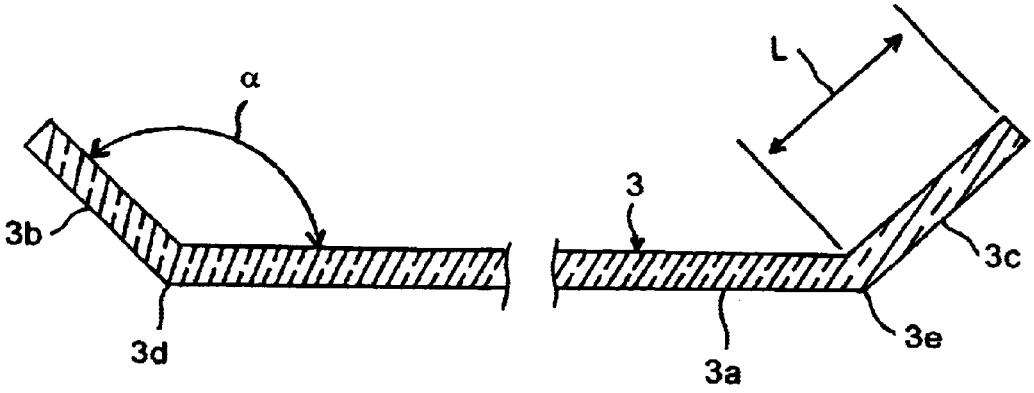
FIG. 5 is a cross-section illustrating the bent configuration of an interior, second, pane for a stove window arrangement in accordance with one embodiment of the present invention.

With reference to FIG. 5, the linear base member or central planar portion 3*a* comprises at its two ends lateral members or planar portions 3*b* and 3*c* which lateral members or adjacent portions 3*b* and 3*c* are inclined at a bending angle $\alpha$ of about 120 degrees to about 135 degrees. The length L of each lateral member 3*b* and 3*c* is typically 30 to 40 millimeters. The window arrangement may have an area comprising a length of about 14 inches (360 millimeters) and a height of about 5 inches (130 millimeters). However, other sizes of a window arrangement are within the scope of the present invention.

Figure 6:
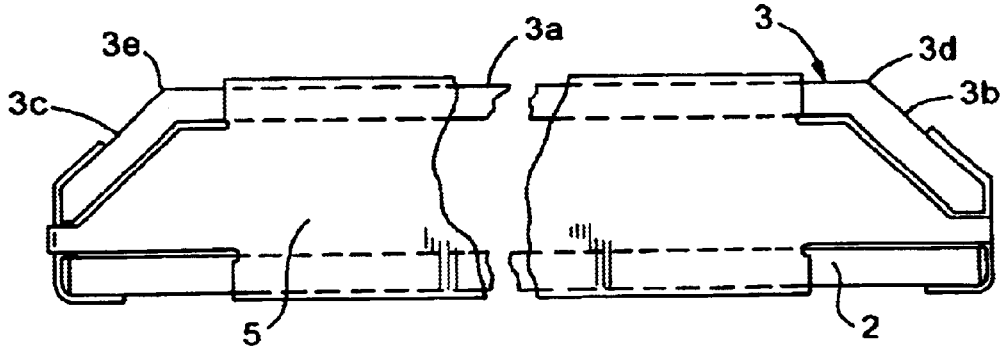
FIG. 6 is a top plan view, which may be considered a drawing with a partial section, of a pair of spaced stove window panes held apart by a spacer structure in a window arrangement in accordance with one embodiment of the present invention.
Figure 7:
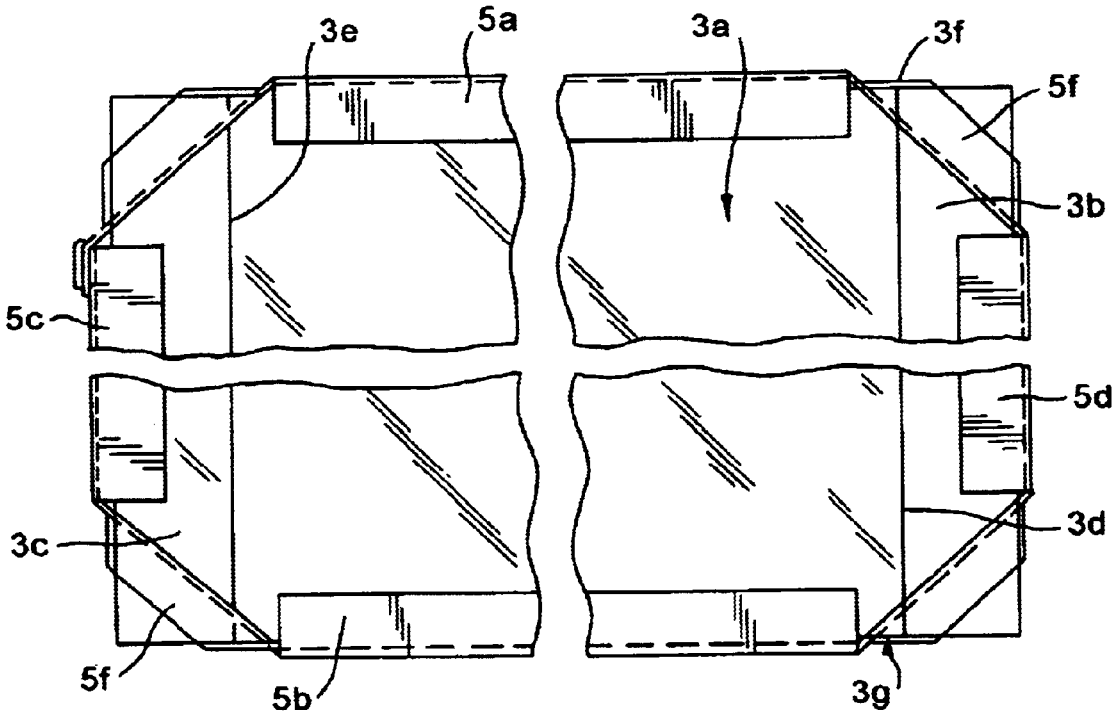
FIG. 7 is an elevational view of the assembly of FIG. 6.

FIGS. 6 and 7 illustrate a window pane arrangement comprising a first pane 2 and a second pane 3 that is shaped with bent portions in accordance with FIG. 5. The panes 2 and 3 are held in spaced apart relationship by a spacer structure 5, comprising an upper retention structure 5*a* and a corresponding lower retention structure 5*b*. The sides of the panes 2 and 3 are disposed in lateral retention structures 5*c* and 5*d*, respectively. There are also provided corner retention structures 5*f*.

It will be appreciated that other spacer structures and window pane configurations are within the scope of the present invention.

Figure 8:
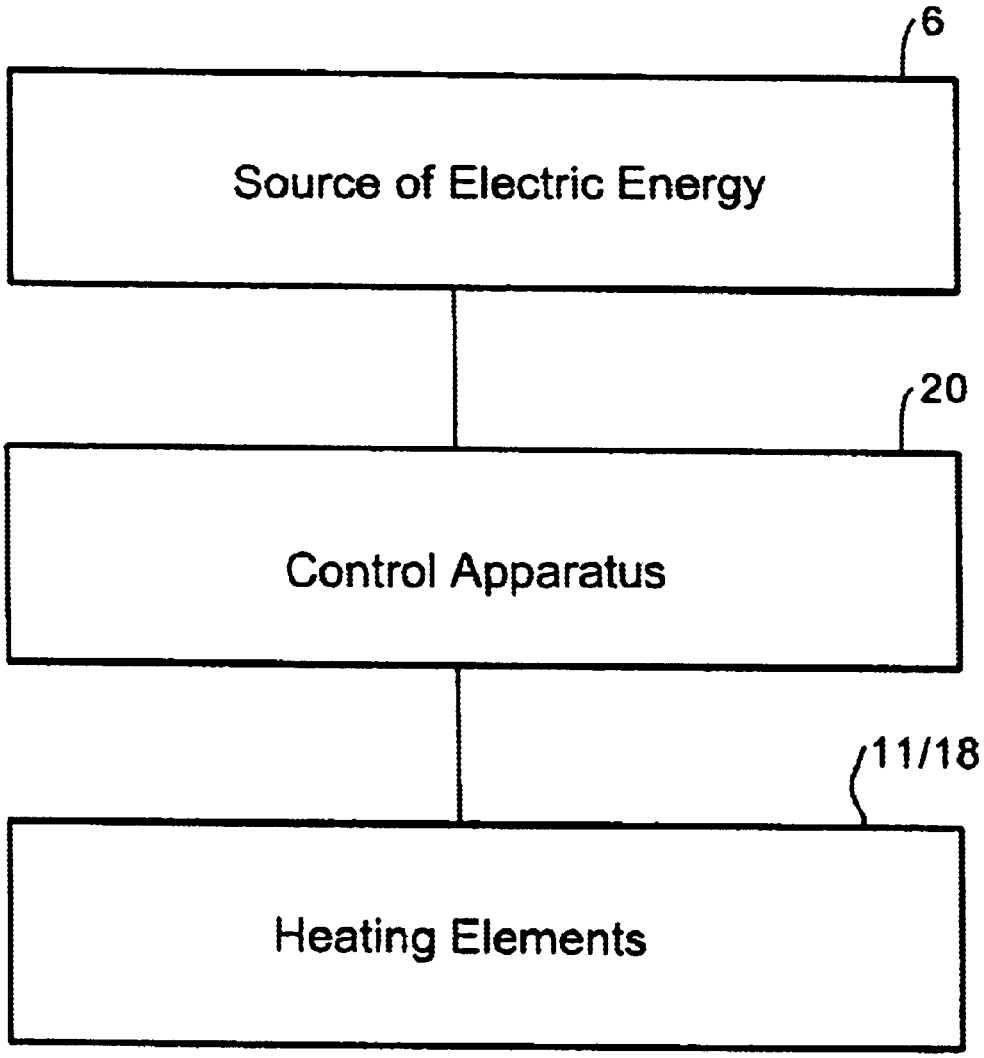
FIG. 8 is a block diagram schematically illustrating an electric heating element control arrangement.

FIG. 8 schematically illustrates the control of heating elements 11/18 by control apparatus 20, with control apparatus 20 controlling the output from a source of electric energy 6.

Figure 9:
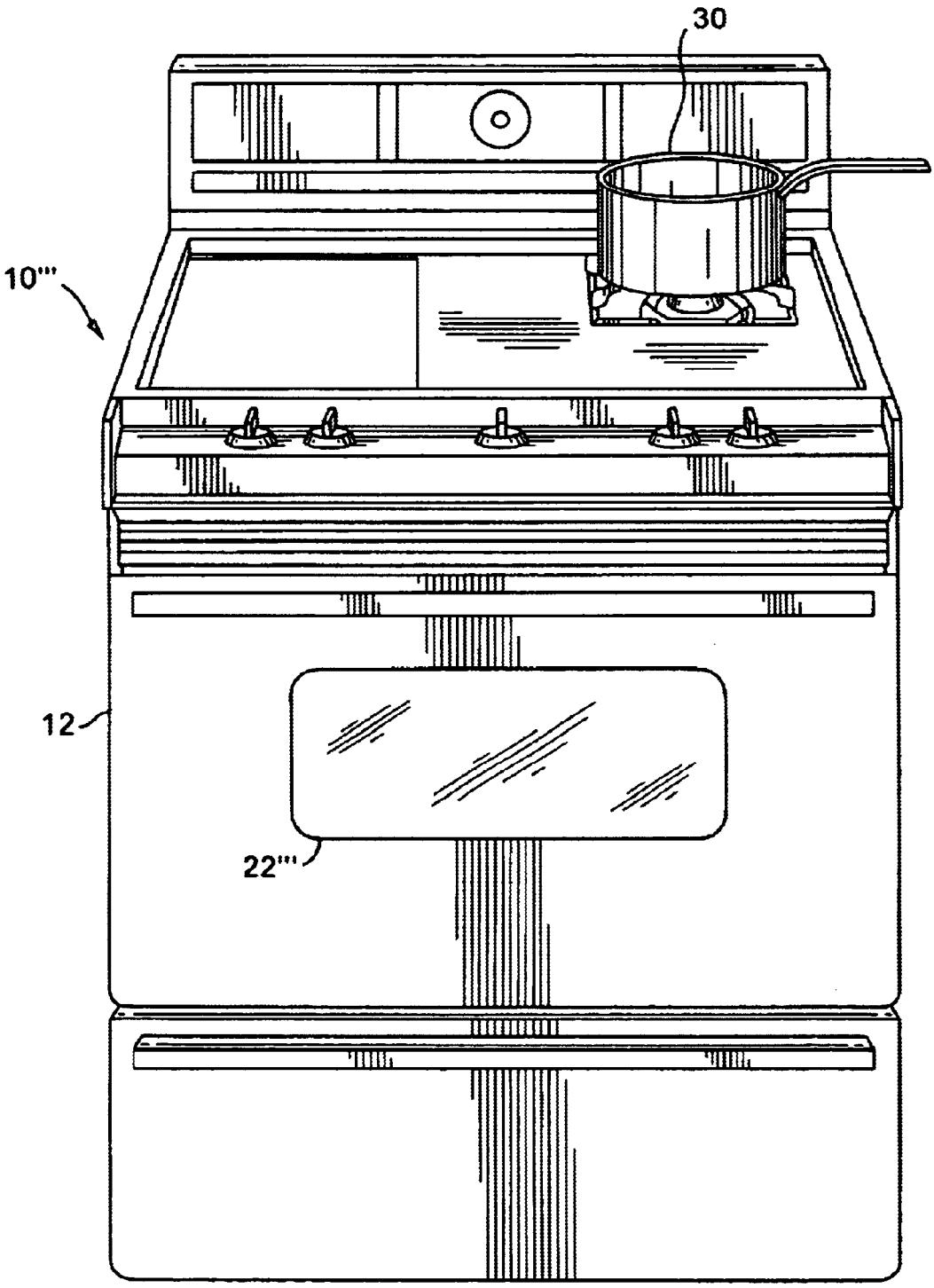
FIG. 9 is a perspective view of a combination electric oven and stove with a window arrangement in accordance with one embodiment of the present invention.

FIG. 9 is an illustration of a combination stove 10''' and oven with a window arrangement 22''' in accordance with one embodiment of the present invention.

Figure 10A:
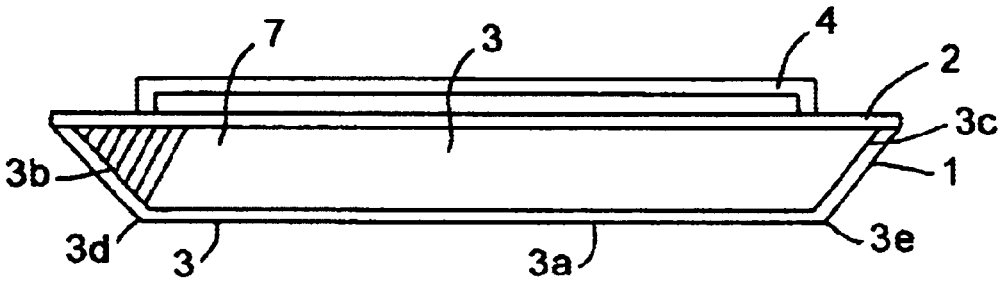
FIG. 10A is a top plan view similar to FIG. 4A and identifying further details of one embodiment of the present invention.
Figure 10B:
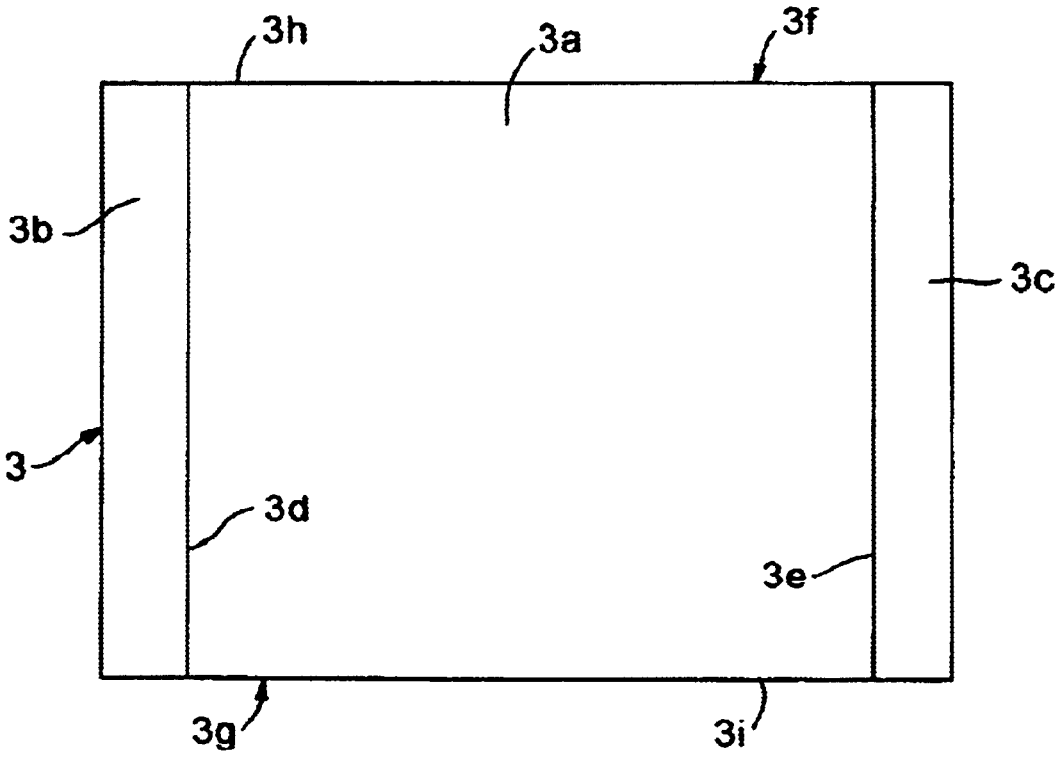
FIG. 10B is an elevation corresponding to FIG. 10A.

FIGS. 10A and 10B are views similar to FIGS. 4A and 4B and showing a possible pane arrangement 7 at the top 3*f* and at the bottom 3*g* of the pane arrangement with panes 2 and 3.

Thus, the invention teaches in one aspect an electric stove, such as stove 10, to cook food, the electric stove comprising: an electric stove body 12, and the electric stove body 12 being configured with an exterior generally identified by reference numeral 16. The top comprises a plurality of electric heating elements 11, each being configured to receive the bottom of a cooking utensil 30 to cook food on electric stove 10. The stove 10 has electric heating element control apparatus 20 to control the operation of the electric heating elements 11 to produce a temperature to cook food on the electric stove. The stove 10 may comprise circuitry schematically illustrated in FIG. 8. Such circuitry is well-known in the art and may be in the manner of the circuitry described in U.S. Pat. No. 3,899,656 issued to Smith on Aug. 12, 1975 and entitled "Self-cleaning oven with temperature limiting protection system for bake and clean." U.S. Pat. No. 3,899,656 is hereby incorporated by reference as if set forth in its entirety herein. Thus, the heating element control apparatus 20 and the plurality of electric heating elements 11 are connected to a source of electric power 6.

The stove also comprises a first electric heating arrangement 18 disposed in the interior 17 to heat food to be cooked in the interior 17 of the electric stove 10 to a desired cooking temperature. The heating arrangement 18 is controlled by corresponding heating arrangement control apparatus 20. The interior 17 of the electric stove typically has a tray or a similar arrangement or arrangements to support a cooking utensil in the interior 17 of the electric stove 10. At least one elements of the electric heating arrangement 18 is typically configured to heat said interior 17 to a temperature greater than the cooking temperature to produce a temperature, by way of corresponding control apparatus 20, sufficient to convert splatters and/or spills produced during cooking in the interior 17 of the electric stove 10 into a converted splatters and/or spills residue more easily removable from the interior 17 of the electric stove 10 than splatters and/or spills produced during cooking in the interior 17 of the electric stove 10. The electric stove 10 has a stove door 24 with a hinge arrangement, not illustrated but known in the art, to permit the stove door 24 to be positioned in a closed position, to close the inlet opening, and in an open position, to open said the inlet opening.

The stove door 24 has a window arrangement 22 with a viewing area having a predetermined height and a predetermined width configured to view the interior 17 of the electric stove 10. The stove door 24 has a suitable mounting arrangement 26 configured to mount the window arrangement 22 to the door 24.

The window arrangement 22 has a first pane 2 and a shaped second pane 3, and a spacer arrangement 5 being configured to maintain the first pane 2 in an outer position with respect to the electric stove interior 17 upon the stove door 24 being in the closed position, and the spacer arrangement 5 being configured to maintain the second pane 3 in a position closer with respect to the electric stove interior 17 than the first pane 2 upon the stove door 24 being in the closed position. The first pane 2 comprises a substantially planar structure having a surface area substantially equal to the viewing area of the window arrangement 22. It is preferred that the first pane 2 comprises an at least partially transparent glass. The second pane 3 comprises a first planar portion 3*b*, a second, central, planar portion 3*a*, and a third planar portion 3*c*. The second, central, planar portion 3*a* has a central portion having a surface disposed substantially parallel with respect to the first pane 2.

Preferably, with reference to FIG. 7, the central portion 3*a* is rectangular, having a first lateral side, corresponding to line or bend 3*d* in FIG. 7, and a second lateral side, corresponding to line or bend 3*e* in FIG. 7, opposite the first lateral side and having a third upper side 3*f* and a fourth lower side 3*g* opposite the upper side 3*f*. The first planar portion 3*b* and the third planar portion 3*c* each preferably have a thickness substantially equal to the thickness of the central planar portion 3*a*. The central planar portion 3*a* is bent, see 3*d* in FIG. 5, at an intersection of the first, lateral, side of the central planar portion 3*a* with the first planar portion 3*b*, and the central planar portion 3*a* is bent, see 3*e* in FIG. 5 at an intersection of the second, lateral, side of the central planar portion 3*a* with the third planar portion 3*c*. The first planar portion 3*b* and the third planar portion 3*c* each are disposed at a substantial angle $\alpha$ transverse to or from the central planar portion 3*a*.

It will be appreciated that the central portion 3*a*, the adjacent portion 3*b*, the adjacent portion 3*c* and the angle $\alpha$ are configured to reduce distortions generated by the window arrangement 22 on the door 24 upon the window arrangement 22 expanding in response to heat impinging on the window arrangement 22.

The configuration of the panes 2 and 3 with respect to one another may be approximately tubular trapezoidal as suggested in FIG. 6. Other configurations within the scope and spirit of the present invention are possible. Accordingly the mentioned angle $\alpha$ may be greater or less as dictated by installation and operating conditions.

In at least one possible embodiment of the invention the ends of the tubular configuration of the panes 2 and 3 may be closed by suitable elements, such as, for example, glass members that are flat, generally identified by pane element 7 in FIG. 10A having a first pane 3*h* to close the top 3*f* and a second pane 3*i* to close the bottom 3*g*. The pane element 7 may bridge the region between the lateral portions 3*b* and 3*c* of inner pane 3. It will be appreciated that such pane element needs to be configured to take into account the expansion due to heat experienced by the window arrangement 22, particularly by the inner pane 3.

One feature of the invention resides broadly in a baking oven door configured to close the feed opening of the oven muffle and comprising a door frame (1), which frame is configured to mount at least two glass and/or glass-ceramic panes (2, 3), the panes being disposed in spaced-apart relationship along one another and the panes comprising an at least partially transparent front pane (2) and a shaped inner pane (3) which inner pane is directed towards the feed opening characterized thereby that the inner pane (3) comprises a linear base member (3*a*), the linear base member having at its two ends lateral members (3*b*, 3*c*) which lateral members are inclined in the direction of the inner pane.

Another feature of the invention resides broadly in a baking oven door characterized thereby that the two angles of inclination are respectively within the range of from 45 degrees to 60 degrees.

Yet another feature of the invention resides broadly in a baking oven door characterized thereby that the length of the lateral members (3*b*, 3*c*) is within the range of from 30 millimeters to 40 millimeters.

Still another feature of the invention resides broadly in a baking oven door characterized thereby that the bending edges (3*a* [3*d*], 3*e*) extend vertically in operation.

A further feature of the invention resides broadly in a baking oven door characterized thereby that the bending edges (3*a* [3*d*], 3*e*) extend horizontally in operation.

In one aspect, the invention relates to a baking oven door that is configured to close the feed opening of the oven muffle and typically comprises a door frame (1), in which frame are secured a glass front pane (2) and a glass inner pane (3). The inner pane (3) is exposed to very high temperature gradients during operation, such gradients extending from the center to the peripheral region, which lead to a deformation of the inner pane concomitantly with a lifting away from the muffle seal. So as to preclude this, the state of the art provides a priori an inner pane that is shaped like a bowl. Since such a shaped inner pane of the prior art is difficult to manufacture, the invention provides that the inner pane (3) comprises a linear base member (3*a*), the linear base member having at its two ends lateral members (3*b*, 3*c*) which are inclined in the direction of the inner pane.

The corresponding foreign patent application, namely, Federal Republic of Germany Patent Application No. 101 49 085.2-23, filed on Oct. 5, 2001, having inventors Kurt LEUTNER, and DE-OS 101 49 085 and DE-PS 101 49 085, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein, are hereby incorporated by reference as if set forth in their entirety.

The appended drawings in their entirety, including all dimensions, proportions and/or shapes in at least one embodiment of the invention, are accurate and to scale and are hereby included by reference into this specification.

The following U.S. Patent Application is to be incorporated by reference as follows: U.S. patent application Ser. No. 09/898,918, filed on Jul. 3, 2001, entitled, "Stove for cooking food with a viewing window, and a viewing window for household appliances, such as cooking stove or ovens, " having inventors Kurt LEUTNER and Oliver GROS, and is hereby incorporated by reference as if set forth in its entirety herein.

The following U.S. Patent Application is to be incorporated by reference as follows: U.S. patent application Ser. No. 09/990,590, filed on Jul. 3, 2001, entitled, "Stove for cooking food with a viewing window, and a viewing window for household appliances, such as cooking stove or ovens," having inventors Oliver GROS and Dr. Peter NAβ, and is hereby incorporated by reference as if set forth in its entirety herein.

The following U.S. Patent Application is to be incorporated by reference as follows: U.S. patent application Ser. No. 10/225,029, filed on Aug. 21, 2002, entitled, "An electric Stove to cook food," having inventors Kurt LEUTNER, Oliver GROS, and Geerd RUPP, and is hereby incorporated by reference as if set forth in its entirety herein.

U.S. patent application Ser. No. 09/931,586, entitled, "Stove for cooking food and like appliances with a door having a window and a temperature indicating device thereon," having inventors Kurt LEUTNER, Oliver GROS, Joachim GRUTZKE, Bernhard GOTZ, and Walter GRAMLICH, filed on Aug. 16, 2001, is hereby incorporated by reference as if set forth in their entirety herein.

All, or substantially all, of the components and methods of the various embodiments may be used with at least one embodiment or all of the embodiments, if more than one embodiment is described herein.

Some examples of self-cleaning stoves and ranges which may possibly be utilized with features of the present invention, or in which features of the present invention may possibly be utilized in one possible embodiment of the present invention may be found in the following U.S. Pat. No. 3,962,561 issued to Maitenaz on Jun. 8, 1976 and entitled "Catalytically assisted pyrolytic self-cleaning oven;" U.S. Pat. No. 4,413,171 issued to Klammers on Nov. 1, 1983 and entitled, "Electric cooking oven for domestic use;" U.S. Pat. No. 4,493,976 issued to Wilson on Jan. 15, 1985 and entitled "Pyrolytic oven cleaning system;" U.S. Pat. No. 4,623,781 issued to Thomas on Nov. 18, 1986 and entitled "Double wall oven with safe limit temperature control;" U.S. Pat. No. 4,775,777 issued to Sinn on Oct. 4, 1988 and entitled "Open-loop self-cleaning oven temperature control;" U.S. Pat. No. 4,930,489 issued to McFadden on Jun. 5, 1990 and entitled "Gas oven having flame switching;" U.S. Pat. No. 5,080,087 issued to McFadden et al. on Jan. 14, 1992 and entitled "Two burner bake, broil and steam gas oven;" U.S. Pat. No. 5,083,010 issued to Henry et al. on Jan. 21, 1992 and entitled "Pyrolytic self-cleaning oven;" U.S. Pat. No. 5,387,258 issued to Puricelli on Feb. 7, 1995 and entitled "Self-cleaning oven;" U.S. Pat. No. 5,405,263 issued to Gerdes et al. on Apr. 11, 1995 and entitled "Sealed gas burner assembly;" U.S. Pat. No. 6,024,084 issued to Gerhardinger on Feb. 15, 2000 and entitled "Double sided heat barrier glass with clear CVD coating and method of making the same;" U.S. Pat. No. 5,584,284 issued to Corliss, II et al. on Dec. 17, 1996 and entitled "Self-cleaning gas-fueled oven for cooking;" U.S. Pat. No. 5,964,211 issued to Sargunam et al. on Oct. 12, 1999 and entitled "Pyrolytic self-cleaning oven;" U.S. Pat. No. 6,222,163 issued to Arntz et al. on Apr. 24, 2001 and entitled "Gas oven incorporating auxiliary electric heating elements;" U.S. Pat. No. 6,232,584 issued to Meyer on May 15, 2001 and entitled "System for controlling a self cleaning oven having catalyst temperature control;" U.S. Pat. No. ,285,290 issued to Kouznetsov on Sep. 4, 2001 and entitled "Self-cleaning oven having smoke detector for controlling cleaning cycle time;" and U.S. Pat. No. 6,437,294 issued to Allera et al. on Aug. 20, 2002 and entitled "Pyrolytic self-cleaning oven." All of the patents cited herein are hereby expressly incorporated by reference as if fully set forth in their entirety herein.

Some examples oven door window frame arrangements, features of which may possibly be used or adapted for use in at least one embodiment of the present invention may be found in the following U.S. Pat. No. 4,074,677 issued to Lotz on Feb. 21, 1978 and entitled "Oven door full front viewing panel;" U.S. Pat. No. 4,253,286 issued to Katona on Mar. 3, 1981 and entitled "Clip-aire oven door window;" U.S. Pat. No. 4,606,324 issued to Katona on Aug. 19, 1986 and entitled "Oven door;" U.S. Pat. No. 5,029,571 issued to Trosin on Jul. 9, 1991 and entitled "Oven door window unit;" U.S. Pat. No. 5,588,421 issued to Busch et al. on Dec. 31, 1996 and entitled "Heat-insulating viewing window or viewing door for an apparatus having an interior temperature deviating from the ambient temperature thereof;" and U.S. Pat. No. 5,799,647 issued to Mills on Sep. 1, 1998 and entitled "Oven door window unit." All of the patents cited herein are hereby expressly incorporated by reference as if fully set forth in their entirety herein.

All of the references and documents, cited in any of the documents cited herein, and the references they are in turn cited in are hereby incorporated by reference as if set forth in their entirety herein. All of the documents cited herein, referred to in the immediately preceding sentence, include all of the patents, patent applications and publications cited anywhere in the present application. All of the references included herein as aforesaid include the corresponding equivalents published by the United States Patent and Trademark Office and elsewhere.

Some examples of seals and gaskets for oven doors, features of which may be used or adapted for use in at least one possible embodiment of the present invention may be found in the following U.S. Pat. No. 4,638,788 issued to Lancelot on Jan. 27, 1987 and entitled "Device for mounting a glass pane on an oven door;" U.S. Pat. No. 4,979,280 issued to Weil on Dec. 25, 1990 and entitled "Gasket assembly and method of making;" and U.S. Pat. No. 5,737,991 issued to Kite, III on Apr. 14, 1998 and entitled "Warp bead oven gasket." All of the patents cited herein are hereby expressly incorporated by reference as if fully set forth in their entirety herein.

The components disclosed in the various publications, disclosed or incorporated by reference herein, may be used in the embodiments of the present invention, as well as, equivalents thereof.

Some examples of keatite and/or high quartz mixed crystal formation, features of which may possibly be incorporated in a possible embodiment of the present invention may be found in the following U.S. Pat. No. 3,938,978 issued to Hummel on Feb. 17, 1976 and entitled "Method of making crystallized glass," U.S. Pat. No. 3,970,463 issued to Planchock et al. on Jul. 20, 1976 and entitled "Glasses and glass-ceramics and products made therefrom," U.S. Pat. No. 4,011,091 issued to McCollister on Mar. 8, 1977 and entitled "Ceramic materials containing keatite," U.S. Pat. No. 4,100,001 issued to Franklin on Jul. 11, 1978 and entitled "Thermally crystallizable glasses and glass-ceramics made therefrom," U.S. Pat. No. 4,391,914 issued to Beall et al. on Jul. 5, 1983 and entitled "Strengthened glass-ceramic articles and method," U.S. Pat. No. 4,861,734 issued to MacDowell on Aug. 29, 1989 and entitled "Alkaline earth aluminoborate glass-ceramics," U.S. Pat. No. 5,212,122 issued to Pannhorst et al. on May 18, 1993 and entitled "Transparent colored glass ceramic with good thermal stability and variable transmission in the IR region," and U.S. Pat. No. 6,043,171 issued to Siebers et al. on Mar. 28, 2000 and entitled "Lead-free and cadmium-free glass compositions for glazing, enamelling and decorating glass of glass-ceramics." All of the patents cited herein are hereby expressly incorporated by reference as if fully set forth in their entirety herein.

The details in the patents, patent applications and publications may be considered to be incorporable, at Applicant's option, into the claims during prosecution as further limitations in the claims to patentably distinguish any amended claims from any applied prior art.

Some examples of crystallizable glass and glass-ceramics made therefrom, features of which may possibly be incorporated in a possible embodiment of the present invention may be found in U.S. Pat. No. 3,970,463 issued to Planchock et al. on Jul. 20, 1976 and entitled "Glasses and glass-ceramics and products made therefrom"; U.S. Pat. No. 4,011,091 issued to McCollister on Mar. 8, 1977 and entitled "Ceramic materials containing keatite"; U.S. Pat. No. 4,100,001 issued to Franklin on Jul. 11, 1978 and entitled "Thermally crystallizable glasses and glass-ceramics made therefrom"; U.S. Pat. No. 4,126,476 issued to Grossman on Nov. 21, 1978 and entitled "Aluminous quartz ceramics and method"; U.S. Pat. No. 4,391,914 issued to Beall et al. on Jul. 5, 1983 and entitled "Strengthened glass-ceramic article and method"; U.S. Pat. No. 6,197,710 issued to Ohara et al. on Mar. 6, 2001 and entitled "Luminous glass ceramics"; and U.S. Pat. No. 6,204,211 issued to Ohara et al. on Mar. 20, 2001 and entitled "Luminous glass ceramics". All of the patents cited herein are hereby expressly incorporated by reference as if fully set forth in their entirety herein.

Some examples of borosilicate glass, features of which may possibly be used or adapted for use in at least one embodiment of the present invention may be found in the following U.S. Pat. No. 4,313,748 issued to Macedo et al. on Feb. 2, 1982; U.S. Pat. No. 4,386,164 issued to Moser on May 31, 1983; U.S. Pat. No. 4,438,210 issued to Rittler on Mar. 20, 1984; U.S. Pat. No. 5,612,262 issued to Kloss et al. on Mar. 18, 1997; and U.S. Pat. No. 6,204,212 issued to Kunert et al. on Mar. 20, 2001. All of the patents cited herein are hereby expressly incorporated by reference as if fully set forth in their entirety herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

Another feature of the invention resides broadly in an appliance to prepare food, such as, an electric stove to cook food, a stove to cook food, an electric stove with an oven to cook food, a stove with an oven to cook food, an oven to cook food, a free-standing stove to cook food, a built-in stove to cook food, a baking oven to bake food, a grill for cooking food, a broiler to broil food, a roasting oven to roast food, a free-standing self-cleaning stove to cook food, a built-in self-cleaning stove to cook food, a self-cleaning baking oven to bake food, an electric stove with a self-cleaning oven to cook food, a stove with a self-cleaning oven to cook food, a self-cleaning oven to cook food, an electric self-cleaning stove to cook food, and a self-cleaning stove to cook food, said appliance comprising: an appliance body being configured with an exterior comprising side walls, a rear wall, a front, a top, and a bottom spaced from said top; a door being configured to be positioned in a closed position and in an open position at said front of said appliance; a hinge arrangement connected between said appliance body and said door and configured to permit said door to be positioned in said closed position and in said open position; said door comprising a window arrangement with a viewing area configured to view the interior of said appliance; said door comprising a mounting arrangement to mount said window arrangement to said door; said window arrangement comprising: a first pane and a second pane; and a spacer arrangement being configured to maintain said first pane in an outer position with respect to the interior of said appliance and said second pane in a position closer with respect to said interior than said first pane upon said door being in the closed position; said second pane comprising a central portion and at least one portion adjacent and connected to said central portion; said at least one adjacent portion being disposed at an angle transverse to said central portion; said window arrangement being configured to expand in response to heat impinging on said window arrangement; said central portion, said at least one adjacent portion, and said transverse angular relationship between said at least one adjacent portion and said central portion of said second pane being configured to reduce distortions of said door by said window arrangement, resulting from expansion of said window arrangement due to heat being produced by said appliance impinging on said window arrangement, to be less than distortions of a corresponding door having a corresponding window arrangement in which a corresponding second pane, corresponding to said second pane, is flat.

All of the patents, patent applications and publications recited herein, and in the Declaration attached hereto, are hereby incorporated by reference as if set forth in their entirety herein.

Yet another feature of the invention resides broadly in an appliance to prepare food, such as, an electric stove to cook food, a stove to cook food, an electric stove with an oven to cook food, a stove with an oven to cook food, an oven to cook food, a free-standing stove to cook food, a built-in stove to cook food, a baking oven to bake food, a grill for cooking food, a broiler to broil food, a roasting oven to roast food, said appliance comprising: a door being configured to be positioned in a closed position and in an open position at said appliance; said door comprising a window arrangement with a viewing area configured to view the interior of said appliance; said door comprising a mounting arrangement to mount said window arrangement to said door; said window arrangement comprising: a first pane and a second pane; and a spacer arrangement being configured to maintain said first pane in an outer position with respect to the interior of said appliance and said second pane in a position closer with respect to said interior than said first pane upon said door being in the closed position; said second pane comprising a central portion and at least one portion adjacent and connected to said central portion; said at least one adjacent portion being disposed at an angle transverse to said central portion; said at least one adjacent portion, said central portion and said transverse angle being configured to reduce distortions generated by said window arrangement on said door upon said window arrangement expanding in response to heat impinging on said window arrangement.

This invention as described hereinabove in the context of the preferred embodiments is not to be taken as limited to all of the provided details thereof, since modifications and variations thereof may be made without departing from the spirit and scope of the invention.

What is claimed is:

1. An electric stove to cook food, said electric stove comprising:

an electric stove body;

said electric stove body being configured with an exterior comprising side walls, a rear wall, a front, a top, and a bottom spaced from said top;

said top comprising an exterior top surface;

a plurality of electric heating elements disposed on said exterior top surface;

said plurality of electric heating elements each being configured to receive the bottom of a cooking utensil to cook food on said electric stove;

electric heating element control apparatus to control the operation of said electric heating elements to produce a temperature to cook food on said electric stove;

electric circuitry configured to connect said heating element control apparatus and said plurality of electric heating elements to a source of electric power;

a first electric heating arrangement disposed in said electric stove and being configured to heat said electric stove to a cooking temperature;

a first electric heating arrangement control apparatus being configured to control the operation of said first electric heating arrangement to produce a cooking temperature to cook food in said electric stove;

an arrangement to support a cooking utensil in said electric stove;

a second electric heating arrangement disposed in said electric stove and being configured to heat said electric stove to a temperature greater than said cooking temperature;

a second heating control apparatus being configured to control said second electric heating arrangement to produce a temperature sufficient to convert splatters and/or spills produced during cooking in said electric stove into a converted splatters and/or spills residue more easily removable from said electric stove than said splatters and/or spills produced during cooking in said electric stove;

said electric stove being configured with an interior comprising an interior top surface, an interior bottom surface, interior side surfaces, and an interior rear surface;

said interior top surface, said interior bottom surface and said interior side surfaces defining an inlet opening to introduce food to be cooked into said interior of said electric stove;

said first electric heating arrangement being disposed in said interior of said electric stove and being configured to heat said interior of said electric stove to a cooking temperature;

said first heating arrangement control apparatus being configured to control the operation of said first electric heating arrangement to produce a cooking temperature to cook food in said interior of said electric stove;

said arrangement to support a cooking utensil being disposed in said interior of said electric stove;

said second electric heating arrangement being disposed in said interior of said electric stove and being configured to heat said interior of said electric stove to a temperature greater than said cooking temperature;

said second heating control apparatus being configured to control said second electric heating arrangement to produce a temperature sufficient to convert splatters and/or spills produced during cooking in said interior of said electric stove into a converted splatters and/or spills residue more easily removable from said interior of said electric stove than said splatters and/or spills produced during cooking in said interior of said electric stove;

said electric stove comprising a stove door;

said stove door and said electric stove comprising a hinge arrangement configured to permit said stove door to be positioned in a closed position, to close said inlet opening, and said hinge arrangement being configured to permit said stove door to be positioned in an open position, to open said inlet opening;

said stove door comprising a window arrangement with a viewing area having a predetermined height and a predetermined width configured to view said interior of said electric stove;

said stove door comprising a mounting arrangement configured to mount said window arrangement to said door;

said window arrangement comprising:

a first pane and a second pane; and a spacer arrangement being configured to maintain said first pane in an outer position with respect to said electric stove interior upon said stove door being in the closed position, and said spacer arrangement being configured to maintain said second pane in a position closer with respect to said electric stove interior than said first pane upon said stove door being in the closed position;

said first pane comprising a substantially planar structure having a surface area substantially equal to said viewing area;

said first pane comprising an at least partially transparent glass;

said second pane comprising a first planar portion, a second, central, planar portion and a third planar portion;

said second, central, planar portion comprising a central portion having a first surface disposed substantially parallel with respect to said first pane;

said central portion being rectangular, having a first side and a second side opposite said first side and having a third side and a fourth side opposite said third side;

said first planar portion and said third planar portion each having a thickness substantially equal to the thickness of said central planar portion;

said central planar portion being bent at an intersection of said first side of said central planar portion with said first planar portion and said central planar portion being bent at an intersection of said second side of said central planar portion with said third planar portion;

said first planar portion and said third planar portion each being disposed at a substantial obtuse angle transverse to said central planar portion; and said central planar portion being configured to expand in response to heat being produced by at least one of said first and second heating arrangements.

2. The electric stove according to claim 1, wherein:

said first planar portion and said third planar portion are configured to vary the magnitude of the corresponding angle of said first and third planar portions with respect to said central planar portion and thus to accommodate force fluctuations of said central planar portion due to expansion resulting from heat being produced on said window arrangement by at least one of said first and said second heating arrangements.

3. The electric stove according to claim 2, wherein:

said angle between said first planar portion and said central planar portion is between about 120 degrees to about 135 degrees, and said angle between said third planar portion and said central planar portion is between about 120 degrees to about 135 degrees.

4. The electric stove according to claim 3, wherein:

said first planar portion has a first end extending from said intersection of said central planar portion and said first planar portion, and a second end opposite said first end of said first planar portion;

said second end of said first planar portion is disposed about 30 millimeters to about 40 millimeters from said first end of said first planar portion; and said third planar portion has a first end extending from said intersection of said central planar portion and said third planar portion, and a second end opposite said first end of said third planar portion;

said second end of said third planar portion is disposed about 30 millimeters to about 40 millimeters from said first end of said third planar portion.

5. The electric stove according to claim 4, wherein:

said bent portions of said central planar portion extend in the direction of one of: substantially vertically, and substantially horizontally.

6. An appliance to prepare food, such as, an electric stove to cook food, a stove to cook food, an electric stove with an oven to cook food, a stove with an oven to cook food, an oven to cook food, a free-standing stove to cook food, a built-in stove to cook food, a baking oven to bake food, a grill for cooking food, a broiler to broil food, a roasting oven to roast food, a free-standing self-cleaning stove to cook food, a built-in self-cleaning stove to cook food, a self-cleaning baking oven to bake food, an electric stove with a self-cleaning oven to cook food, a stove with a self-cleaning oven to cook food, a self-cleaning oven to cook food, an electric self-cleaning stove to cook food, and a self-cleaning stove to cook food, said appliance comprising:

an appliance body being configured with an exterior comprising side walls, a rear wall, a front, a top, and a bottom spaced from said top;

a door being configured to be positioned in a closed position and in an open position at said front of said appliance;

a hinge arrangement connected between said appliance body and said door and configured to permit said door to be positioned in said closed position and in said open position;

said door comprising a window arrangement with a viewing area configured to view the interior of said appliance;

said door comprising a mounting arrangement to mount said window arrangement to said door;

said window arrangement comprising:

a first pane and a second pane; and a spacer arrangement being configured to maintain said first pane in an outer position with respect to the interior of said appliance and said second pane in a position closer with respect to said interior than said first pane upon said door being in the closed position;

said second pane comprising a central portion and at least one portion adjacent and connected to said central portion;

said at least one adjacent portion being disposed at an angle transverse to said central portion;

said window arrangement being configured to expand in response to heat impinging on said window arrangement;

said central portion, said at least one adjacent portion, and said transverse angular relationship between said at least one adjacent portion and said central portion of said second pane being configured to reduce distortions of said door by said window arrangement, resulting from expansion of said window arrangement due to heat being produced by said appliance impinging on said window arrangement, to be less than distortions of a corresponding door having a corresponding window arrangement in which a corresponding second pane, corresponding to said second pane, is flat.

7. The appliance according to claim 6, wherein:

said central portion is flat and said at least one adjacent portion is flat; and said angle between said flat central portion and said at least one flat adjacent portion is between about 120 degrees to about 135 degrees.

8. The appliance according to claim 7, wherein:

said central portion has a first side and a second side opposite said first side;

said at least one adjacent portion is connected at said first side of said central portion to form a bent portion at an intersection of said at least one adjacent portion and said central portion;

said at least one adjacent portion has a first end extending from said intersection and a second end opposite said first end of said at least one adjacent portion;

said second end of said at least one adjacent portion is disposed about 30 millimeters to about 40 millimeters from said first end;

and wherein:

said bent portion extends in the direction of one of: substantially vertically, and substantially horizontally.

9. The appliance according to claim 6, including at least one of: (a.), (b.), (c.), (d.), (e.), and (f.), wherein (a.), (b.), (c.), (d.), (e.), and (f.) are:

(a.) said central portion is flat and said at least one adjacent portion is flat;

(b.) said angle between said central portion and said at least one adjacent portion is between about 120 degrees to about 135 degrees;

(c.) said central portion has a first side and a second side opposite said first side;

said at least one adjacent portion is connected at said first side of said central portion to form a bent portion at an intersection of said at least one adjacent portion and said central portion;

said at least one adjacent portion has a first end extending from said intersection and a second end opposite said first end of said at least one adjacent portion;

said second end is disposed about 30 millimeters to about 40 millimeters from said first end; and said bent portion extends in the direction of one of: substantially vertically, and substantially horizontally;

(d.) said central portion comprises an area substantially greater than the area of said at least one adjacent portion;

(e.) said first pane comprises one of: a glass, and a glass-ceramic, and said second pane comprises one of: a glass, and a glass-ceramic; and (f.) said appliance comprises one of: an oven to cook food, and a baking oven to bake food.

10. The appliance according to claim 6, including all of: (a.), (b.), (c.), (d.), (e.), and (f.), wherein (a.), (b.), (c.), (d.), (e.), and (f.), are:

(a.) said central portion is flat and said at least one adjacent portion is flat;

(b.) said angle between said flat central portion and said at least one flat adjacent portion is between about 120 degrees to about 135 degrees;

(c.) said central portion has a first side and a second side opposite said first side;

said at least one adjacent portion is connected at said first side of said central portion to form a bent portion at an intersection of said at least one adjacent portion and said central portion;

said at least one adjacent portion has a first end extending from said intersection and a second end opposite said first end of said at least one adjacent portion;

said second end is disposed about 30 millimeters to about 40 millimeters from said first end; and said bent portion extends in the direction of one of: substantially vertically, and substantially horizontally;

(d.) said central portion comprises an area substantially greater than the area of said at least one adjacent portion;

(e.) said first pane comprises one of: a glass, and a glass-ceramic, and said second pane comprises one of: a glass, and a glass-ceramic; and (f.) said appliance comprises one of: an oven to cook food, and a baking oven to bake food.

11. An appliance to prepare food, such as an electric stove to cook food, a stove to cook food, an electric stove with an oven to cook food, a stove with an oven to cook food, an oven to cook food, a free-standing stove to cook food, a built-in stove to cook food, a baking oven to bake food, a grill for cooking food, a broiler to broil food, a roasting oven to roast food, said appliance comprising:

a door being configured to be positioned in a closed position and in an open position at said appliance;

said door comprising a window arrangement with a viewing area configured to view the interior of said appliance;

said door comprising a mounting arrangement to mount said window arrangement to said door;

said window arrangement comprising:

a first pane and a second pane; and a spacer arrangement being configured to maintain said first pane in an outer position with respect to the interior of said appliance and said second pane in a position closer with respect to said interior than said first pane upon said door being in the closed position;

said second pane comprising a central portion and at least one portion adjacent and connected to said central portion;

said at least one adjacent portion being disposed at an angle transverse to said central portion;

said at least one adjacent portion, said central portion and said transverse angle being configured to reduce distortions generated by said window arrangement on said door upon said window arrangement expanding in response to heat impinging on said window arrangement.

12. The appliance according to claim 11, wherein:

said central portion is flat and said at least one adjacent portion is flat.

13. The appliance according to claim 12, wherein:

said angle between said central portion and said at least one adjacent portion is between about 120 degrees to about 135 degrees.

14. The appliance according to claim 13, wherein:

said central portion has a first side and a second side opposite said first side;

said at least one adjacent portion is connected at said first side of said central portion to form a bent portion at an intersection of said at least one adjacent portion and said central portion;

said at least one adjacent portion has a first end extending from said intersection and a second end opposite said first end of said at least one adjacent portion;

said second end of said at least one adjacent portion is disposed about 30 millimeters to about 40 millimeters from said first end.

15. The appliance according to claim 14, wherein:

said bent portion extends in the direction of one of: substantially vertically, and substantially horizontally.

16. The appliance according to claim 15, wherein:

said central portion comprises an area substantially greater than the area of said at least one adjacent portion.

17. The appliance according to claim 16, wherein:

said first pane comprises one of: a glass, and a glass-ceramic, and said second pane comprises one of: a glass, and a glass-ceramic.

18. The appliance according to claim 11, wherein:

said appliance comprises an oven to cook food.

19. The appliance according to 18, wherein:

said oven comprises a baking oven to bake food.

20. The appliance according to claim 11, including at least one of: (a.), (b.), (c.), (d.), (e.), and (f.), wherein (a.), (b.), (c.), (d.), (e.), and (f.) are:

(a.) said central portion is flat and said at least one adjacent portion is flat;

(b.) said angle between said central portion and said at least one adjacent portion is between about 120 degrees to about 135 degrees;

(c.) said appliance comprises one of: an electric self-cleaning stove to cook food, and a self-cleaning stove to cook food, an oven to cook food, and a baking oven to bake food.

(d.) said central portion has a first side and a second side opposite said first side;

said at least one adjacent portion is connected at said first side of said central portion to form a bent portion at an intersection of said at least one adjacent portion and said central portion;

said at least one adjacent portion has a first end extending from said intersection and a second end opposite said first end of said at least one adjacent portion;

said second end is disposed about 30 millimeters to about 40 millimeters from said first end; and said bent portion extends in the direction of one of: substantially vertically, and substantially horizontally;

(e.) said central portion comprises an area substantially greater than the area of said at least one adjacent portion; and (f.) said first pane comprises one of: a glass, and a glass-ceramic, and said second pane comprises one of: a glass, and a glass-ceramic.

* * * * *